United States Patent [19]

Beretta

[11] 4,236,337

[45] Dec. 2, 1980

[54] REVERSIBLE SLIDING MAGAZINE LATCH FOR PISTOLS

[75] Inventor: Pier C. Beretta, Gardone V.T., Italy

[73] Assignee: Fabrica d'Armi Pietro Beretta S.p.A., Gardone V.T., Italy

[21] Appl. No.: 943,116

[22] Filed: Sep. 18, 1978

[30] Foreign Application Priority Data

Oct. 24, 1977 [IT] Italy ..... 5235 A/77

[51] Int. Cl.[3] ..... F41C 25/06

[52] U.S. Cl. ..... 42/7

[58] Field of Search ..... 42/7

[56] References Cited

U.S. PATENT DOCUMENTS 984,519 2/1911 Browning ..... 42/7

FOREIGN PATENT DOCUMENTS 672094 2/1939 Fed. Rep. of Germany ..... 42/7

*Primary Examiner*—Charles T. Jordan

[57] ABSTRACT

A pistol is disclosed that may be used by either right or left handed individuals. A spring biased U-shaped latch is located in the pistol handle and may be reversed in position without any special skills or tools. In either position the latch temporarily blocks the removal of the magazine. A force exerted on the latch in opposition to the biasing force permits removal and reversal of the latch.

4 Claims, 9 Drawing Figures

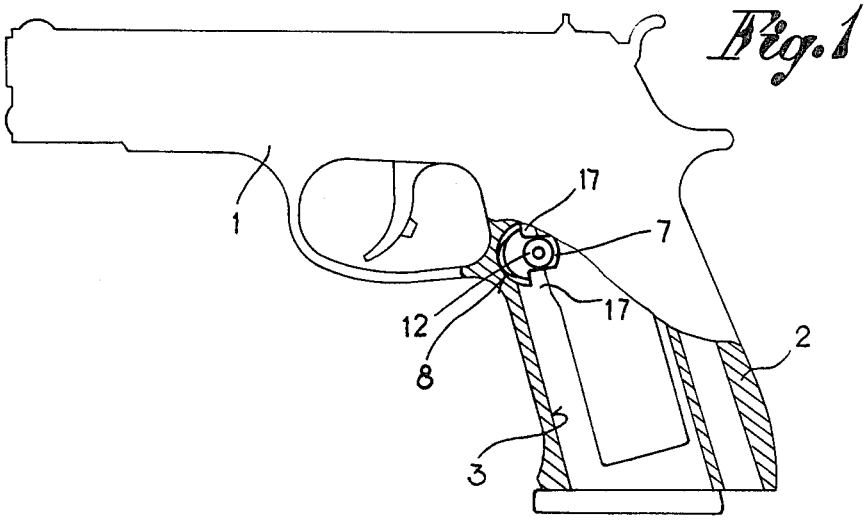
Fig. 1
Fig. 3
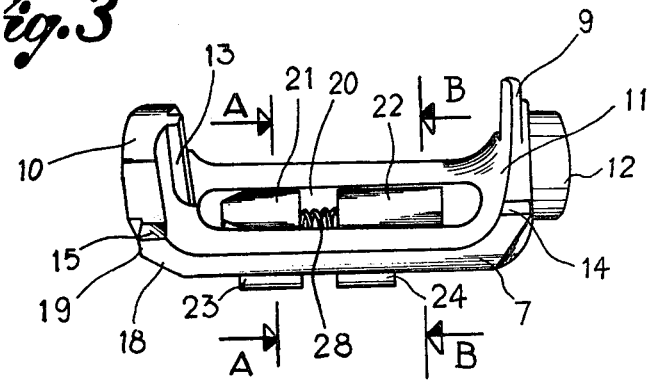
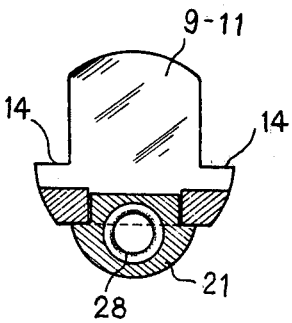
Fig. 4
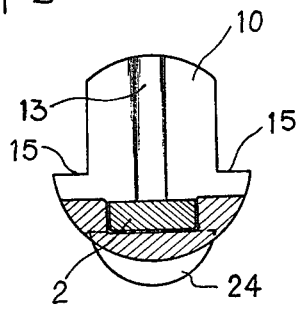
Fig. 5

REVERSIBLE SLIDING MAGAZINE LATCH FOR PISTOLS

FIELD OF THE INVENTION

The present invention relates to a sliding latch for blocking and unblocking the magazine of a pistol.

DESCRIPTION OF THE PRIOR ART

In the field of automatic firearms and, more particularly, of pistols, it is already known to employ latches for blocking and unblocking the magazine component of the pistol. Among the known latches there is one which is of the sliding type and which is seated and guided transversely with respect to the cavity receiving the magazine, so as to engage a notch provided on a lateral surface of the magazine. However, all sliding latches heretofore known have a unidirectional and irreversible use, in the sense that they may be utilized either only from left to right, in the case of right-handed individuals, or only from right to left, in the case of left-handed individuals. This limitation is an inconvenience because pistols become impractical when used by persons that shoot with the opposite hand.

It is evident that it is necessary for the manufacturer to make at the beginning a pistol which is to be used solely by either right-handed or left-handed individuals. Furthermore, the retailer and the distributor must stock almost twice the quantity of firearms, in order to be able to satisy every customer's demand.

SUMMARY OF THE INVENTION

It is, therefore, an object of the present invention to provide a latch for magazines of pistols, wherein the mounting and the use of the latch are reversible, so that the pistol may be used both as a right-handed latch pistol and as a left-handed latch pistol.

It is another object of the invention to provide a reversible latch which is easily assembled and disassembled, so as to be positionally exchanged by the user himself without requirement of special mechanical knowledge or special tools.

Briefly stated, the latch of the present invention comprises a body member slidably guided in a seat of the pistol handle, so as to be transversely oriented with respect to the magazine to be blocked. The body is provided with spring-actuated means which engage under pressure between two shoulders provided at the bottom of the seat, and allow the operational displacements of the latch. The body also has two end projections one of which has thereon a push-button and the other of which has thereon an inner rib for blocking the magazine. Both end projections have sliding planes which cooperate with respective shoulders provided laterally on the handle of the pistol. These sliding planes are so arranged as to allow disassembly of the body of the latch when a push is applied thereon in the direction contrary to that exerted on the button actuating the latch.

BRIEF DESCRIPTION OF THE DRAWINGS

These and other objects of the present invention will become more evident from the following detailed description thereof with reference to the accompanying drawings, illustrative but not limitative of the invention, in which:

FIGS. 1 and 2 are partially sectioned and fragmentary side elevational views of two pistols with, respectively, a left and a right latch:

FIG. 3 is a perspective view, on an enlarged scale, of the latch of the invention;

FIGS. 4 and 5 are transverse sectional views of the latch taken in the direction of arrows A—A and B—B, respectively of FIG. 3;

DESCRIPTION OF THE PREFERRED EMBODIMENTS

Figure 6:
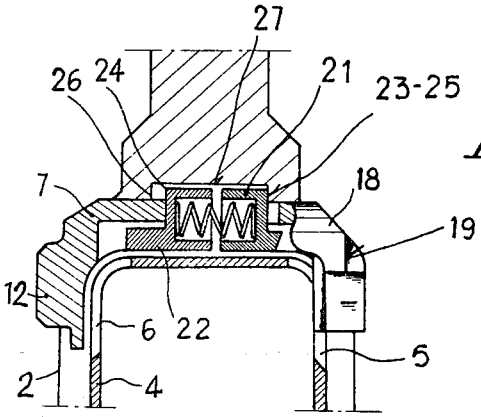
FIG. 6 is a transverse sectional view of the mounting of the latch in the blocking position for a right-handed pistol.

With reference to the drawings, numeral 1 refers generally to a pistol having a handle 2 in which there is provided a cavity 3 for a magazine 4. The magazine 4 is provided with two lateral notches or slots 5 and 6 (FIG. 6), one on each side, one or the other of which notches serving to engage a latch as taught hereinafter by the invention. The latch comprises a substantially U-shaped body member 7 mounted on and guided slidably in a seat 8 provided in the handle 2 of the pistol 1. The latch's body extends transversely with respect to the cavity 3 for the magazine 4.

The body member 7 has a pair of end projections 9–10, one of which has an inner flat surface 11 and is provided with an external push-button 12, while the other projection 10 has a rib 13 on its inner surface. The rib 13 is arranged to engage one of the two lateral notches 5–6 of the magazine 4, in order to block it within the cavity 3.

Laterally of the end projections 9–10 there are two sliding planes or surfaces 14 and 15, respectively, the function of which is to cooperate with the respective shoulders 16–17 that are provided on the side surfaces of the handle 2 in alignment with the seat 8 of the latch body member 7. The sliding planes 14–15, together with their shoulders 16–17, prevent, on one hand, the latch 7 from falling into the cavity 3 for the mazagine 4, and permit, on the other hand, a perfect guiding action during the displacements of the latch 7.

At the base of end projection 10 (the one with the rib 13) and externally thereof there is an inclined or bevelled plane or surface 18 which connects with the sliding plane 15 via a pair of head-guides 19. The bevelled plane 18 serves as a means for the pressure-assembling of the latch 7, as will be described hereinafter. The head-guides 19 serve to center and guide the shoulder 16 or 17 along the sliding plane 14 or 15, during said assembling phase.

In the intermediate portion of the body member 7 there is a cavity 20 for guiding two small and opposed pistons 21–22. These pistons 21–22 are engaged by a spring 28 positioned therebetween which keeps them normally spaced from each other. The pistons 21–22 are provided with coupling and guiding surfaces to couple them with the body member 7 and they protrude from the base of the body member so as to form, with their outwardly facing surfaces two stops 23–24 which serve the purpose of engaging against two shoulders 25–26 defined by a cavity 27 provided at the base of the seat 8 of the latch body member 7.

Figure 2:
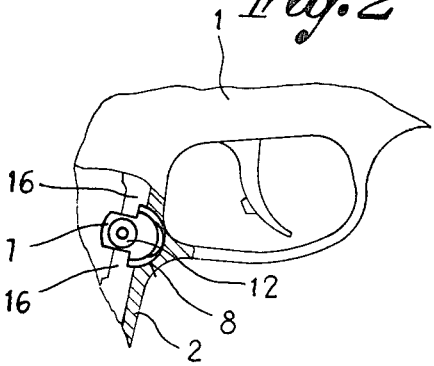

As stated hereinabove, the latch body member 7 of the invention is reversible. In fact, it can be mounted on the handle 2 of the pistol so as to beused either from left to right as shown in FIG. 1 or from right to left as shown in FIG. 2. In the first case, the latch body member 7 is mounted so that its push button 12 is on the left hand side of the pistol 1 and its rib 13 engages the notch 5 of the right side surface of the magazine 4 (FIG. 6). The latch guide is thus insured by the sliding coupling of the sliding surface 14 with the respective shoulder 16, and of the sliding surface 15 with the respective shoulder 17.

Under these conditions, in order to effect the unblocking of the magazine, it is sufficient to exert pressure on the push button 12 in the direction opposed to that of spring 28 of pistons 21–22, the pressure being sufficient to disengage the rib 13 from the notch 5, so that the magazine 4 is free to exit from the cavity 3 of the handle 2. During this operation, the stop 23 of the piston 21 rests against the shoulder 25, while the piston 22 is displaced with respect to piston 21.

To reverse the position, and thus the use of the latch body member 7, and to have the push button 12 on the right hand side of the pistol 1 and the rib 13 in engagement with the notch 6 on the left hand side of the magazine 4, it is necessary first to extract the latch body member 7 from seat 8 and then to re-insert it facing the opposite side.

Figure 7:
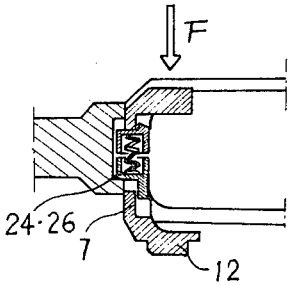
FIGS. 7 and 8 are sectional plan views of two successive phases of disassembling the latch during the step of reversing it.
Figure 8:
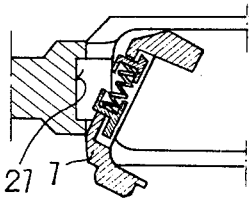

The disassembly of the latch body member 7 is done with the magazine 4 removed from cavity 3 and is achieved by exerting pressure on the end-projection 10, as shown by arrow F in FIG. 7. This will displace the latch body member 7 toward the other end projection 9 and will achieve the disengagement of the surface 15 of end projection 10 from the corresponding shoulder 17. As a result, the latch body member 7 becomes angularly oriented, as shown in FIG. 8, and can be removed, disengaging also the sliding surface 14 from the corresponding shoulder 16 of the side surface of the handle 2.

Figure 9:
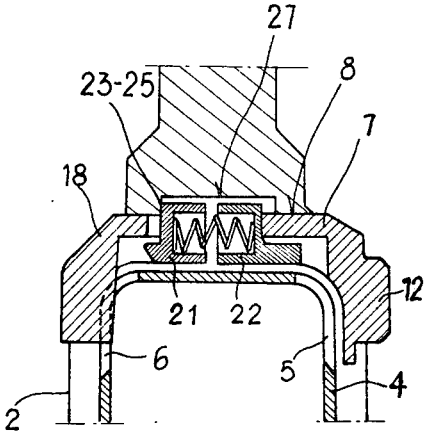
FIG. 9 is a transverse sectional view of the assembling of the latch in a left-handed used pistol.

The latch body member 7 is then reassembled in the seat 8 of the handle 2 by carrying out an operation reverse to the one described hereinabove, so that the push button 12 is positioned on the right hand side of the pistol 1, as shown in FIGS. 2 and 9. The assembling of the latch body member 7 is effected by keeping it in an oblique position, as stated above, and by coupling first the surface 14 of end projection 9 with the corresponding shoulder 17, and then pushing the latch body member 7 toward the base of the seat 8.

The completion of the seating of the latch body member 7 in the seat 8 occurs snap-wise and it is aided by the bevelled surface as well as by the head-guide 19 of the latch body member 7. Elements 18 and 19, in contact with the shoulders 16, determine thusly the compression of the spring 28 of the pistons 21 and 22 and the guiding of shoulders 16 toward the sliding surfaces 15. When the surfaces 15 are in juxtaposition with the shoulders 16, the reaction of the spring 28 (in cooperation with the positioning of the pistons 21–22 between the shoulders 25–26) automatically prepositions the latch body member 7 in sliding condition for use.

From the above, it is evident that the assembly of the latch body member 7 on the handle 2 is rapidly and easily reversible and can be carried out by anyone without special tools, so as to obtain a weapon usable equally by right-handed and left-handed persons.

I claim:

1. A sliding magazine latch for pistols having a handle and a magazine, said latch being positioned in a seat provided in the handle of said pistol, so as to be transversely oriented with respect to the magazine, which latch comprises:
   (a) a U-shaped body member with first and second terminal projections;
   (b) a push button positioned externally of said first projection;
   (c) a rib positioned internally of said second projection for blocking said magazine; (d) sliding surfaces positioned on the side of both said first and second projections and associated with corresponding shoulders provided in the side surfaces of the handle of said pistol;
   (e) spring loaded means positioned at the base of said body member between a pair of shoulders provided at the base of the seat of said latch to permit operative displacements thereof, said spring-loaded means and said sliding surfaces being combined to permit the assembly of said body member when pressure is exerted thereon in a direction contrary to that exerted on the push button for the actuation of the latch.

2. The latch according to claim 1, wherein at the base of said second projection there is provided a bevelled surface which cooperates with the sliding surface by means of guides provided on the head of said body member.

3. The latch according to claim 1, wherein the spring-loaded means are two pistons guided within a cavity provided at the base of the U-shaped body member; a spring being positioned between said pistons for keeping them spaced apart; said pistons protruding from the base of the body member to form with their farthest extremities a pair of shoulders cooperating with the shoulders provided in the base of the latch seat.

4. The latch according to claim 1, wherein said latch is reversible for use from left to right and from right to left.

* * * * *

UNITED STATES PATENT AND TRADEMARK OFFICE

CERTIFICATE OF CORRECTION

PATENT NO. : 4,236,337

DATED : December 2, 1980

INVENTOR(S) : Pier Carlo Beretta

It is certified that error appears in the above-identified patent and that said Letters Patent are hereby corrected as shown below:

Change the name of the assignee from:

Fabrica d'Armi Pietro Beretta S.p.A.

to

Fabbrica d'Armi Pietro Beretta S.p.A.

Signed and Sealed this

*Tenth* Day of *March 1981*

[SEAL]

*Attest:*

RENE D. TEGTMEYER

*Attesting Officer* *Acting Commissioner of Patents and Trademarks*